US007221881B2

(12) United States Patent
Do

(10) Patent No.: US 7,221,881 B2
(45) Date of Patent: May 22, 2007

(54) IMAGE FORMING APPARATUS CONTROLLING CHARGE OF TONER AND METHOD THEREOF

(75) Inventor: Ki-Jae Do, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 143 days.

(21) Appl. No.: 11/030,961

(22) Filed: Jan. 10, 2005

(65) Prior Publication Data

US 2005/0158061 A1 Jul. 21, 2005

(30) Foreign Application Priority Data

Jan. 20, 2004 (KR) ..... 10-2004-0004335

(51) Int. Cl.
*G03G 15/00* (2006.01)
*G03G 15/08* (2006.01)

(52) U.S. Cl. ..... 399/44; 399/53; 399/284

(58) Field of Classification Search ..... 399/44, 399/53, 55, 284, 285, 286
See application file for complete search history.

(56) References Cited

U.S. PATENT DOCUMENTS 4,314,755 A 2/1982 Kinashi ..... 355/14 D
5,029,314 A 7/1991 Katsumi et al. ..... 355/208
5,819,131 A * 10/1998 Kim ..... 399/44
6,671,485 B2 * 12/2003 Hirano ..... 399/284

FOREIGN PATENT DOCUMENTS

| | | |
|---|---|---|
| JP | 06-027807 | 4/1994 |
| JP | 11-119521 | 4/1999 |
| JP | 2002-057948 | 2/2002 |
| KR | 1997-066751 | 10/1997 |

* cited by examiner

*Primary Examiner*—Hoang Ngo
(74) *Attorney, Agent, or Firm*—Roylance, Abrams, Berdo & Goodman, LLP

(57) ABSTRACT

An image forming apparatus and method for controlling a charge of a toner are provided. The apparatus and method includes a toner supplying roller; a developing roller for supplying the toner to an organic photoconductor; a charge controller for adjusting the charge of the toner on the developing roller; a developing current detector for detecting a change in current for a developing voltage; and a charge controlling voltage controller for adjusting a charge controlling voltage according to the detection result. The apparatus can uniformly maintain the quality of an image by recognizing a change in the charge of toner based on a change in the environment. Also, the image forming apparatus indicates a proper toner replacement time by determining when the charge of the toner is abnormally low as a toner shortage state and displaying the toner shortage state on a panel operating unit.

18 Claims, 3 Drawing Sheets

IMAGE FORMING APPARATUS CONTROLLING CHARGE OF TONER AND METHOD THEREOF

CROSS-REFERENCE TO RELATED APPLICATIONS

This application claims the benefit under 35 U.S.C. 119(a) of Korean Patent Application No. 2004-4335, filed on Jan. 20, 2004, in the Korean Intellectual Property Office, the entire contents of which are incorporated herein by reference.

BACKGROUND OF THE INVENTION

1. Field of the Invention

The present invention relates to an image forming apparatus capable of controlling the charge of toner and a method thereof. More particularly, the present invention relates to an image forming apparatus and method for determining the charge of a toner from a development current with respect to a development voltage supplied to a developing roller and control the charge of the toner based thereon.

2. Description of the Related Art

Generally, an image forming apparatus adopting an electrophotographic method, such as a laser beam printer, which is also simply referred to as a laser printer, forms an image by forming an electrostatic latent image by scanning a laser beam to an organic photoconductor and attaching toner to the electrostatic latent image. Herein, the toner is typically charged with a negative (−) voltage to attach the toner to the organic photoconductor. The quality of the image formed in the image forming apparatus depends on the quantity of the toner attached to the organic photoconductor based on the charge of the toner.

FIG. 1 is a schematic diagram illustrating a conventional electrophotographic image forming apparatus.

The conventional image forming apparatus comprises a toner supplying roller 10, a developing roller 30, a blade 36, a charging roller 60, an organic photoconductor 50, and a fixing roller 70. The toner supplying roller 10 is charged with a high negative voltage, e.g., −500V, by a first power source 20 and provides toner to the developing roller 30. The developing roller 30 is charged with a high negative voltage, e.g., −300V, by a second power source 35, receives the toner attached to the toner supplying roller 10 by a potential difference from the toner supplying roller 10, and supplies the toner to an organic photoconductor (OPC) 50. The blade 36 maintains the uniform thickness of the toner attached to the developing roller 30. The charging roller 60 charges the organic photoconductor 50 with a high negative voltage, e.g., −700V, by a third power source 65. The organic photoconductor 50, which is charged by the charging roller 60, forms an electrostatic latent image in the part scanned by a laser scanning unit (LSU) 80 and attaches the toner to the electrostatic latent image. The fixing roller 70 fixes the toner attached to the electrostatic latent image which is formed in the organic photoconductor 50 on paper P. In the image forming apparatus with the above-described structure, the charge of the toner depends on a surrounding environment of the image forming apparatus, such as, a temperature and humidity. If the charge of the toner is increased, the quantity of the toner attached to the developing roller 30 is increased more than necessary and thus ghost images may be generated in the image printed on the paper P by the organic photoconductor 50 and the fixing roller 70, or the concentration of the toner on the print is increased more than necessary. If the toner has a lower charge, the toner layer attached to the developing roller 30 becomes so thin that it becomes a film on the surface of the developing film 30 or on the surface of the organic photoconductor 50. In this case, the quantity of the toner supplied to the organic photoconductor 50 is insufficient and the image printed on the paper P is indistinct or streaks are generated on the image.

FIG. 2 illustrates an example of the force acting on the toner between the organic photoconductor 50 and the developing roller 30.

The toner T is supplied to the organic photoconductor 50 by a potential difference between the developing roller 30 which is charged with about −300V and the organic photoconductor 50 which is charged with about −700V. Herein, a force Fd in which the toner T moves towards the organic photoconductor 50 is in proportion to the charge q of the toner and an electric field Ed between the developing roller 30 and the organic photoconductor 50. The force Fd can be expressed as an equation 1 below.

$$Fd=q\times Ed \qquad \text{Eq. 1}$$

Meanwhile, a force Fr in which the toner T is attached to the developing roller 30 is a summation of a Van der Wall's force and an image force. The Van der Wall's force Fm is expressed as an equation 2 below.

$$Fm=\frac{q^2}{4\pi\times\varepsilon r^2} \qquad \text{Eq. 2}$$

wherein q denotes the charge of the toner, and $\epsilon r$ denotes a dielectric rate of air.

Based on the equations 1 and 2, the charge of the toner T and the forces Fd and Fr according to the charge can be expressed as a graph shown in FIG. 3.

It can be seen from FIG. 3 that the toner T attached to the developing roller 30 is supplied to the organic photoconductor 50 in appropriate amounts at a charge q' where the force Fd having a shape of a one-dimensional function and the force Fr having a shape of a two-dimensional function has the largest difference. The charge q' has a different value according to electrophotographic image forming apparatuses. An electrophotographic image forming apparatuses produced by the Samsung Electronics company has a value of 12 to 20 uC/g. As shown in FIG. 3, if the toner T is charged less than 12 uC/g, or if the charge of the toner T is charged more than 20 uC/g, the quantity of the toner T attached to the developing roller 30 is decreased or increased, respectively, to an abnormal level and the toner T is not attached to the developing roller 30 uniformly and mechanical friction with the blade 36 which limits the thickness of the toner T attached to the developing roller 30 is increased. The increase in the mechanical friction between the blade 36 and the toner T can strip off the additives added to the toner T, such as $SiO_2$ and $TiO_2$. The additives are added to the toner T in the form of surrounding toner T particles to thereby prevent toner particles from being combined with each other and from being fused onto the organic photoconductor 50. If the additives are removed or damaged, the toner T can be fused onto the organic photoconductor 50 in the form of a film or degrades the quality of the image formed in the image forming apparatus.

SUMMARY OF THE INVENTION

It is an object of the present invention to provide an image forming apparatus and method that can uniformly maintain the quality of an image by increasing or decreasing the charge of toner properly according to the surrounding environment of the electrophotographic image forming apparatus.

In accordance with an aspect of the present invention, there is provided an image forming apparatus capable of controlling a charge of a toner, the apparatus which includes: a toner supplying roller for charging toner to a predetermined level; a developing roller for supplying the toner from the toner supplying roller to an organic photoconductor; a charge controller for increasing/decreasing the charge of the toner attached to the developing roller; a developing current detector for detecting a change in current with respect to a developing voltage supplied to the developing roller; and a charge controlling voltage controller for increasing/decreasing a charge controlling voltage supplied to the charge controller according to the detection result of the developing current detector.

The charge controlling voltage controller may include data on the charge controlling voltage corresponding to the developing current in the form of a lookup table and changes the charge controlling voltage corresponding to the developing current according to the change in the developing current.

The charge controlling voltage controller may include an analog-digital converter for performing analog-digital conversion on a detection result of the developing current detector; a memory for storing data on the charge controlling voltage corresponding to the developing voltage; and a processor for comparing the conversion result of the analog-digital converter with the data on the charge controlling voltage and increasing/decreasing the charge controlling voltage based on the comparison result.

The charge controlling voltage may be a direct current (DC) voltage.

The image forming apparatus may further include a blade for limiting the thickness of the toner attached to the developing roller, the blade being placed apart from the developing roller by a predetermined space.

The image forming apparatus may further include a blade for limiting the thickness of the toner attached to the developing roller, the blade contacting with the developing roller.

In accordance with another aspect of the present invention, there is provided an image forming apparatus capable of controlling a charge of a toner. The apparatus includes a toner supplying roller for charging toner to a predetermined level of charge; a developing roller for supplying the toner from the toner supplying roller to an organic photoconductor; a charge controller for increasing/decreasing the charge of the toner attached to the developing roller; a blade for limiting the thickness of the toner attached to the developing roller, the blade being placed apart from the developing roller by a predetermined space; a blade current detector for detecting a current for a blade voltage supplied to the blade; a developing current detector for detecting a change in current with respect to a developing voltage supplied to the developing roller; and a blade voltage controller for increasing/decreasing a blade voltage supplied to the blade according to the detection result of the developing current detector.

The blade may contact the developing roller.

The blade voltage controller may include data on the blade voltage corresponding to the developing current in the form of a lookup table and changes the blade voltage according to a difference between the voltage for the developing current and the blade voltage.

The blade voltage controller may include an analog-digital converter for performing analog-digital conversion on a detection result of the developing current detector; a memory for storing data on the blade voltage corresponding to the detected developing current; and a processor for comparing the conversion result of the analog-digital converter with the data on the blade voltage and increasing/decreasing the blade voltage based on the comparison result.

In accordance with another aspect of the present invention, there is provided an image forming apparatus, which includes a developing roller for performing development by carrying toner; a toner layer limiting means for forming a toner layer of a uniform thickness on the developing roller; a toner supplying roller for supplying the toner to the developing roller; a charge controller for controlling charge by contacting the developing roller under a development area; an environment detector for detecting the state of an environment of the image forming apparatus; and a controller for controlling the voltage of the charge controller variably based on the environment state detected in the environment detector.

The environment detector may be any one of a thermosensor and a hygrosensor for detecting a temperature and a humidity.

The image forming apparatus may further include an organic photoconductor for forming an electrostatic latent image and attaching the toner supplied from the developing roller to the formed electrostatic latent image; a charging roller for charging the organic photoconductor with a predetermined voltage; and a transferring roller for fusing an image based on the electrostatic latent image formed in the organic photoconductor onto paper, wherein the environmental state is any one of a current of the charging roller and a current of the transferring roller.

The image forming apparatus may use a non-magnetic and non-contact one-ingredient developing method.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1:
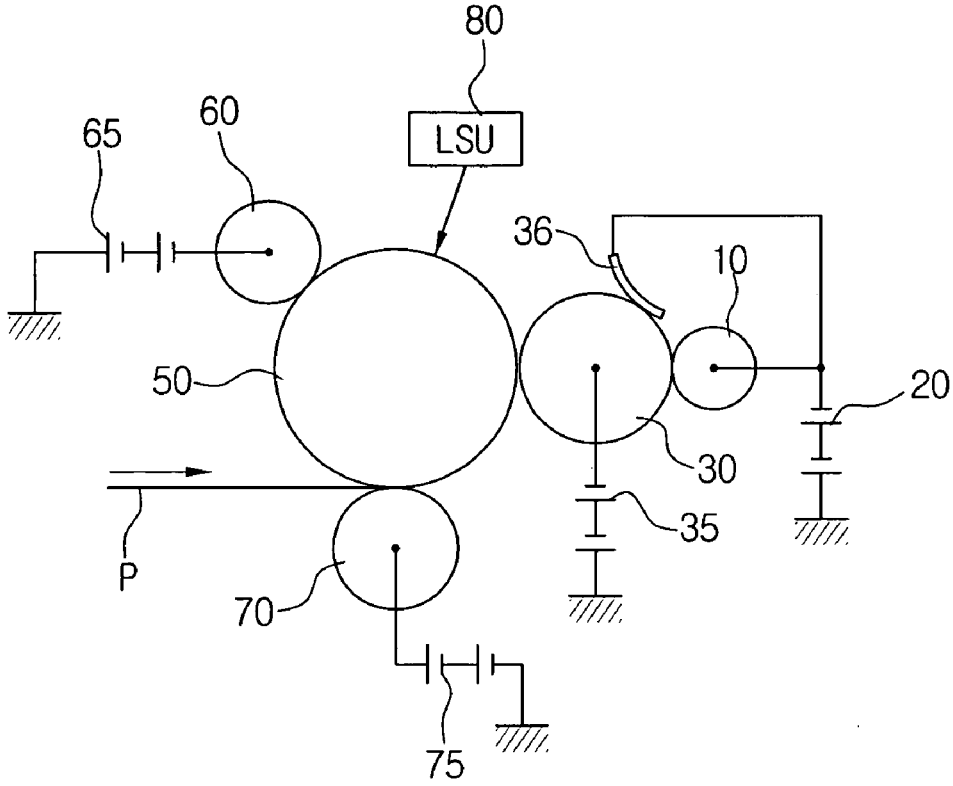
FIG. 1 (PRIOR ART)
FIG. 1 is a schematic diagram illustrating a conventional image forming apparatus adopting an electrophotographic method.

Certain embodiments of the present invention will be described in greater detail with reference to the accompanying drawings.

In the following description, the same drawing reference numerals are used for the same elements throughout the drawings. The matters defined in the description such as a detailed construction and elements are exemplary. Thus, it should be apparent that the embodiments of the present invention can be performed without the specific examples. Also, well-known functions or constructions are not described for conciseness.

Figure 2:
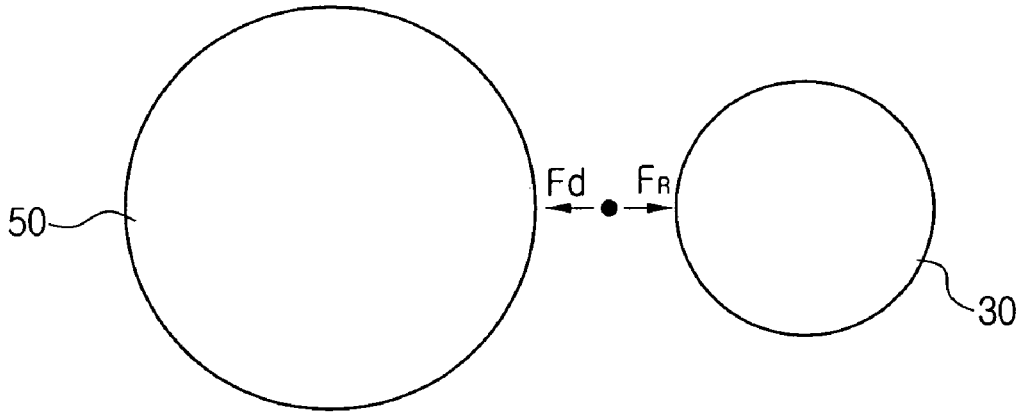
FIG. 2 (PRIOR ART)
FIG. 2 is a diagram illustrating an example of a force acting on toner between an organic photoconductor and a developing roller of FIG. 1.
Figure 3:
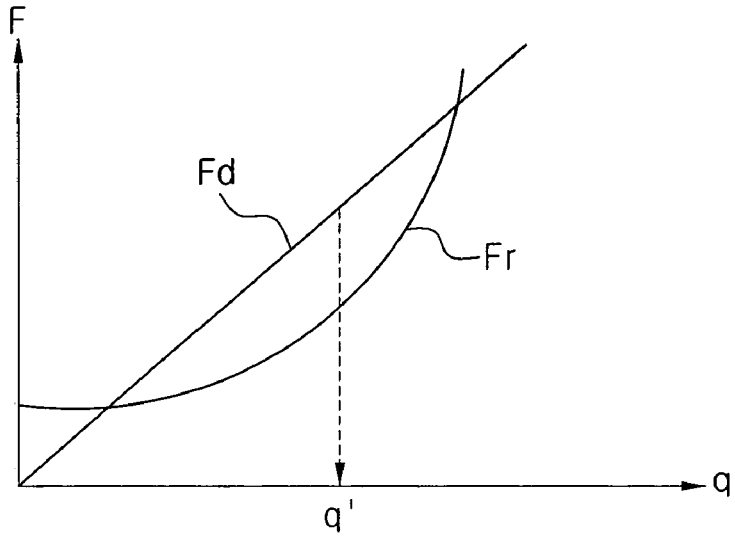
FIG. 3 (PRIOR ART)
FIG. 3 is a graph illustrating the charge of toner and a force based on the charge of the toner.
Figure 4:
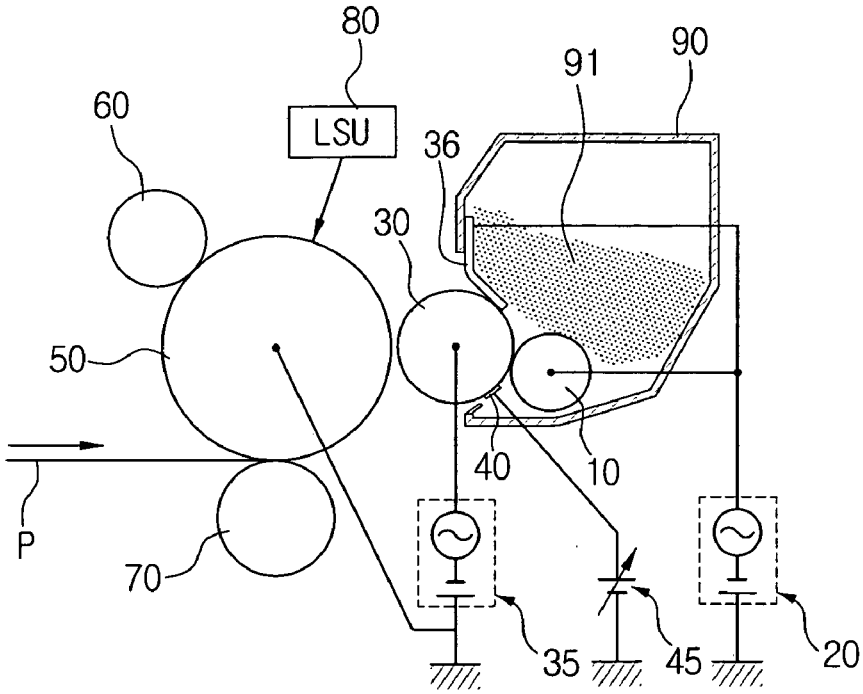
FIG. 4 is a schematic diagram describing an image forming apparatus in accordance with an embodiment of the present invention.

FIG. 4 is a schematic diagram illustrating an image forming apparatus in accordance with an embodiment of the present invention. Herein, the image forming apparatus will be described with reference to FIGS. 1 and 2, too, and the same element having the same function of FIG. 1 is given the same reference numeral.

As shown, the image forming apparatus of the present invention comprises a toner supplying roller 10, a developing roller 30, a blade 36, a charge controller 40, a charge controlling voltage supplier 45, a charging roller 60, an organic photoconductor (OPC) 50, and a fixing roller 70. Toner reservoir 90 stores the toner 91. The toner supplying roller 10 is charged with a high negative voltage, e.g., −500V, by a blade voltage 20 to supply toner to the developing roller 30. The developing roller 30 is charged with a high negative voltage, e.g., −300V, by a developing voltage 35 and receives the toner 91 attached to the toner supplying roller 10 by a potential difference from the toner supplying roller 10, and supplies the toner 91 to the organic photoconductor 50. The blade 36 uniformly maintains the thickness of the toner 91 attached to the developing roller 30. The charge controller 40 contacts the developing roller 50 and controls the charge of the toner 91 attached to the developing roller 30. The charge controlling voltage supplier 45 supplies a charge controlling voltage to the charge controller 40. The charging roller 60 charges the organic photoconductor 50 with a high negative voltage, e.g., −700V. The organic photoconductor OPC 50 is charged by the charging roller 60, and it forms an electrostatic latent image in the part scanned by a laser scanning unit LSU 80 and attaches the toner 91 to the formed electrostatic latent image. The fixing roller 70 fixes the toner 91 attached to the electrostatic latent image formed in the organic photoconductor 50 onto the paper P. The charge controller 40 controls the charge of the toner 91 attached with the negative (−) charge by supplying a positive (+) voltage to the developing roller 30 by contacting the developing roller 30 under a development area. In an embodiment of the present invention, the developing roller 30 detects developing current which is changed when the charge of the toner 91 is changed due to the surrounding environment of the image forming apparatus, e.g., a temperature and humidity, and varies the charge of the toner 91 based on the detected developing current. The developing current is in proportion to the charge of the toner 91 and the quantity of the toner 91. In short, if the toner 91 attached to the developing roller 30 is increased or the charge of the toner 91 is increased, the developing current is increased. In contrast, the developing current is decreased. Therefore, in an embodiment, the present invention controls the charge of the toner 91 and the quantity of the toner 91 attached to the developing roller 30 by detecting the developing current that varies according to the charge of the toner 91 and the quantity of the toner 91 and varying the charge controlling voltage or a blade voltage which corresponds to the detected developing charge based on voltage data arranged in the form of a lookup table.

Figure 5:
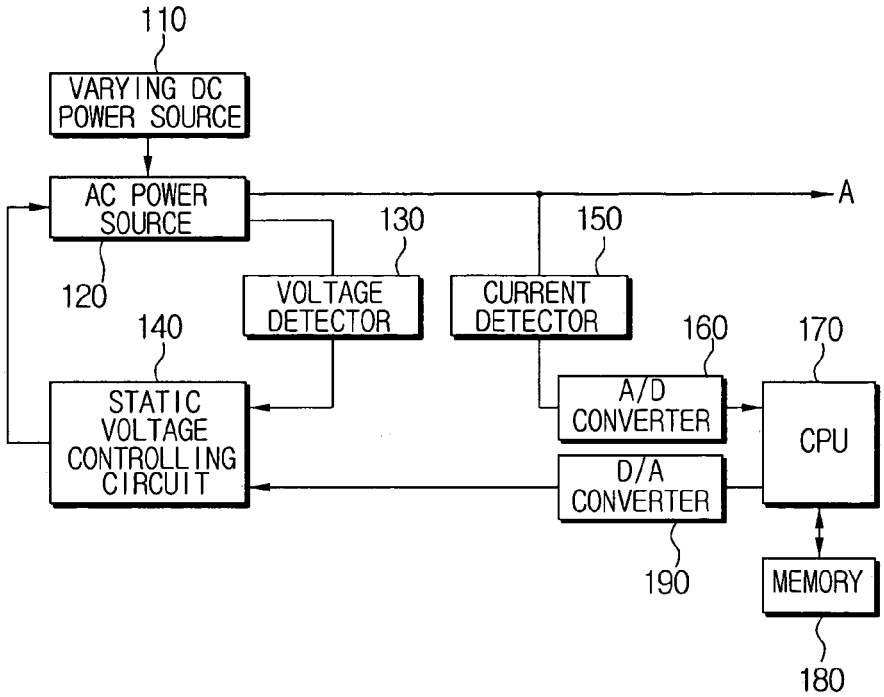
FIG. 5 is a block diagram illustrating a voltage controller for varying a charge controlling voltage and a blade voltage, and a power source connected to the voltage controller of FIG. 4.

FIG. 5 is a block diagram depicting a voltage controller for varying a charge controlling voltage and a blade voltage, and a power source connected to the voltage controller of FIG. 4.

The voltage controller and the power source include a varying direct current (DC) power source 110, an alternating current (AC) power source 120, a voltage detector 130, a static voltage controlling circuit 140, a current detector 150, an analog-digital (A/D) converter 160, a central processing unit (CPU) 170, a digital-analog (D/A) converter 190, and a memory 180.

The varying DC power source 110 generates a DC voltage to be supplied to the developing roller 30. Since a voltage of around −500V is required to charge the developing roller 30 with a voltage of around −300V conventionally, the output voltage of the varying DC power source 110 is about −500V. Herein, it is revealed that the values can be different more or less according to electrophotographic image forming apparatuses and there is a wide deviation according to manufacturing companies of the image forming apparatuses, too. Thus, the same values cannot be applied thereto.

The AC power source 120 generates a rectangular AC voltage, e.g., −1.8 KV, according to a pre-established frequency and combines the AC voltage with a DC voltage generated in the varying DC power source 110. The combined voltage is supplied to the developing roller 30 to thereby charge the developing roller 30. The voltage detector 130 detects the combined voltage and supplies it to the static voltage controlling circuit 140. The static voltage controlling circuit 140 controls the combined voltage output from the AC power source 120 by controlling the AC power source 120 based on the detection result of the voltage detector 130.

The current detector 150 detects a current of the combined voltage output from the AC power source 120. The A/D converter 160 converts it into a digital signal and supplies the digital signal to the CPU 170. The memory 180 includes data on the charge of the toner 91 corresponding to a developing current and data on the charge controlling voltage according to the charge of the toner 91. The CPU 170 obtains an appropriate voltage value for the charge controlling voltage from the memory based on the detection result of the current detector 150 and controls the charge controlling voltage outputted from a charge controlling voltage generator 45 based on the appropriate voltage value. The CPU 170 maintains the charge of the toner 91 at a uniform level, e.g., 12 uC/g to 20 uC/g, by adjusting the charge controlling voltage according to the charge of the toner 91 attached to the developing roller 30. Meanwhile, the drawing shows the CPU 170 controlling the charge and controlling voltage generator 45 to adjust the charge controlling voltage. However, the charge controlling voltage generator 45 can be replaced by a blade voltage generator 20 for generating a blade voltage and, since the charge of the toner 91 attached to the developing roller 30 can be controlled by adjusting a blade voltage, a drawing and description for describing how the blade voltage is controlled will be omitted herein.

Table 1 below shows the charge of the developing current according to the charge of the toner 91.

TABLE 1

| Charge of Toner 91 (uC/g) | Developing Current (uA) |
|---|---|
| −8 uC/g | 0.5 uA |
| −12 uC/g | 1.0 uA |
| −18 uC/g | 1.8 uA |
| −25 uC/g | 3.0 uA |

It can be seen from the table 1 that the developing current supplied to the developing roller 30 is changed according to the charge of the toner 91. If the charge of the toner 91 is increased, the developing current is increased, too. If the charge of the toner 91 is decreased, the developing current is decreased. In an embodiment, the present invention determines the charge of the toner 91 based on the detected developing current and, if the charge of the toner 91 is out of the predetermined level, e.g., 12 uC/g to 20 uC/g, it controls the charge of the toner 91 by varying the voltage supplied from the adjacent blade 36 or the charge controller 40.

Table 2 below shows the relationship between the charge of the toner 91 and the charge controlling voltage based on the developing current of Table 1.

TABLE 2

| Charge | Charge Controlling Voltage | | | |
|---|---|---|---|---|
| of Toner 91 | 0 V | 100 V | 200 V | 300 V |
| −8.0 uC/g | −7.0 uC/g | −7.0 uC/g | −6.0 uC/g | −6.0 uC/g |
| −12 uC/g | −11.0 uC/g | −10.0 uC/g | −9.0 uC/g | −8.0 uC/g |
| −18 uC/g | −15.0 uC/g | −15.0 uC/g | −13.0 uC/g | −13.0 uC/g |
| −25 uC/g | −20.0 uC/g | −18.0 uC/g | −16.0 uC/g | −16.0 uC/g |

It can be seen from Table 2 that, if the charge controlling voltage is increased in the range of 0V to 300V, the charge of the toner 91 is decreased generally. This phenomenon is caused when a positive (+) voltage is supplied to the toner 91 charged with negative (−) charge. An appropriate charge of the toner 91 can be established by determining the charge of the toner 91 for the current detected in the current detector 150 and adjusting the charge controlling voltage based on the determined charge and the table 2.

Table 3 below shows the relationship between the charge of the toner 91 based on the developing current of table 1 and the blade voltage.

TABLE 3

| Charge | Developing Voltage − Blade Voltage | | | |
|---|---|---|---|---|
| of Toner 91 | 0 V | 100 V | 200 V | 300 V |
| −8.0 uC/g | −8.0 uC/g | −9.0 uC/g | −11.0 uC/g | −13.0 uC/g |
| −12 uC/g | −12.0 uC/g | −14.0 uC/g | −15.0 uC/g | −15.0 uC/g |
| −18 uC/g | −18.0 uC/g | −19.0 uC/g | −19.0 uC/g | −20.0 uC/g |
| −25 uC/g | −25.0 uC/g | −25.0 uC/g | −26.0 uC/g | −26.0 uC/g |

It can be seen from Table 3 that, if the difference between the blade voltage and the developing voltage is increased, the charge of the toner 91 is increased generally. The CPU 170 determines the charge of the toner 91 with respect to the current detected in the current detector 150 and controls an appropriate charge of the toner 91 by adjusting the charge controlling voltage based on the determined charge level and the table 2. The memory 180 includes the tables 1 to 3 on the charge controlling voltage and the blade voltage for acquiring a proper charge level for the toner 91, and the CPU 170 maintains the quality of images formed in the electrophotographic image forming apparatus uniformly by adjusting the charge controlling voltage and the blade voltage based on the tables in the memory 180.

Meanwhile, although not illustrated in the drawings, it is possible to estimate the charge of the toner 91 by using a thermosensor (not shown) and/or a hygrosensor (not shown) connected to the CPU 170 and adjust the voltage supplied to the charge controller 40 based on the estimated charge. For this, the variation of the charge of the toner 91 based on the temperature and humidity in the surrounding environment of the image forming apparatus is stored in the memory 180 in the form of a lookup table, and the CPU 170 adjusts the charge controlling voltage supplied to the charge controller 40 by controlling the charge controlling voltage supplier 45 according to the detected temperature and humidity. In this case, too, the data on the charge of the toner 91 based on the temperature and humidity should be pre-stored in the image forming apparatus. If there is no additional A/D converter in the CPU 170, it is desirable to place the A/D converter between the CPU 170 and the sensors, e.g., the thermosensor and the hygrosensor. If the voltage supplied to the charge controller 40 is adjusted by estimating the charge of the toner 91 from the thermosensor or the hygrosensor, it is not necessary to measure the developing current of the developing roller 30 through the charging process.

Figure 6:
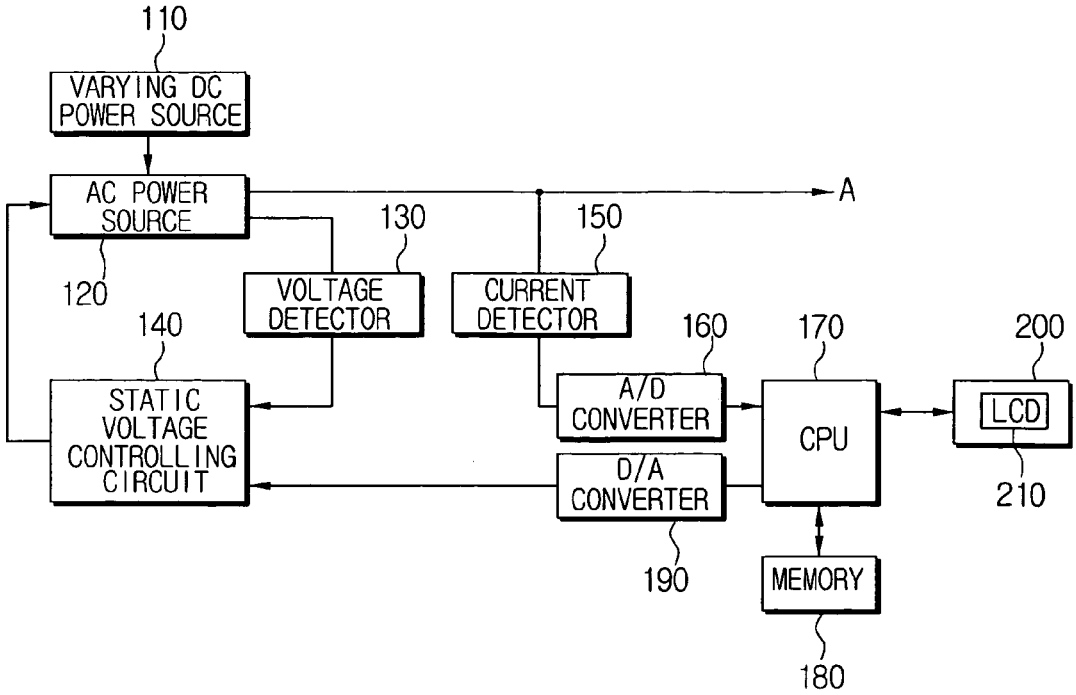
FIG. 6 is a block diagram illustrating an image forming apparatus capable of detecting lack of toner in accordance with an embodiment of the present invention.

FIG. 6 is a block diagram describing an image forming apparatus capable of detecting lack of toner in accordance with an embodiment of the present invention.

FIG. 6 is substantially the same as FIG. 5 except if the current detected in the current detector 150 is lower than the pre-established current, the image forming apparatus recognizes that it is due to a lack of the toner 91 and displays the toner 91 shortage state on a liquid crystal display (LCD) 210 in a panel controlling unit 200.

As described with reference to table 1, if the developing current is decreased, the blade voltage and a blade current thereof are decreased as well. In other words, if the developing current is less than a predetermined level of current, e.g., less than 0.5 uA, the blade current is decreased in proportion to the developing current. The CPU 170 can estimate the lack of toner 91 based on the supplied blade current value by storing the blade current value with respect to the developing current in the memory 180. Likewise, since the current supplied to the toner supplying roller 10 is decreased when the developing current is decreased, the same result can be obtained by detecting the voltage supplied to the toner supplying roller 10. In short, in case where the output voltage (Vout) is supplied to the toner supplying roller 10 as shown in the drawing, the lack of toner 91 can be determined by detecting a current value for the voltage supplied to the toner supplying roller 10 in the current detector 150, performing analog-digital conversion on the detected current value, and supplying the digital value to the CPU 170. Herein, the data on the developing current corresponding to the lack of toner 91 and data on the current values of the toner supplying roller 10 are pre-stored in the memory 180.

It is desirable that the image forming apparatus uses a non-magnetic and non-contact one-ingredient developing method. Generally, developing methods are classified into a dry method and a wet method according to a developing agent. In the dry method, power-type toner is used as a developer and, in the wet method, a liquid-type developer in which toner is combined with a liquid type carrier is used as the developer. The dry developing method using the power-type toner is also divided into a two-ingredient developing method which uses toner having two ingredient including carrier particles for carrying toner particles and a one-ingredient developing method which uses only toner without using any carrier. The one-ingredient developing method is divided into a magnetic one-ingredient developing method and a non-magnetic one-ingredient developing method. The magnetic one-ingredient developing method uses magnetic one-ingredient toner, and the non-magnetic one-ingredient developing method uses a non-magnetic one-ingredient developing toner to form a toner layer on the developing roller and performs development in contact or non-contact with the organic photoconductor.

As described above, the embodiments of the present invention uniformly maintain the quality of images formed in the image forming apparatus uniformly by recognizing a change in the charge of the toner based on the change in the surrounding environment of the image forming apparatus through a change in the developing current and adjusting the charge of the toner properly according to the recognition result. Also, the image forming apparatus according to embodiments of the present invention can inform a user of a proper toner replacement time by determining a time when the charge of the toner is abnormally low such as in a toner shortage state and display the toner shortage state.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An image forming apparatus capable of controlling a charge of a toner, comprising:

a toner supplying roller for charging toner to a predetermined level of charge;

a developing roller for supplying the toner from the toner supplying roller to an organic photoconductor;

a charge controller for increasing/decreasing the charge of the toner attached to the developing roller;

a developing current detector for detecting a change in current with respect to a developing voltage supplied to the developing roller; and a charge controlling voltage controller for increasing/decreasing a charge controlling voltage supplied to the charge controller according to the detection result of the developing current detector.

2. The image forming apparatus as recited in claim 1, wherein the charge controlling voltage controller includes data on the charge controlling voltage corresponding to the developing current in the form of a lookup table and changes the charge controlling voltage corresponding to the developing current according to the change in the developing current.

3. The image forming apparatus as recited in claim 2, wherein the charge controlling voltage controller comprises:

an analog-digital converter for performing analog-digital conversion on a detection result of the developing current detector;

a memory for storing data on the charge controlling voltage corresponding to the developing voltage; and a processor for comparing the conversion result of the analog-digital converter with the data on the charge controlling voltage and increasing/decreasing the charge controlling voltage based on the comparison result.

4. The image forming apparatus as recited in claim 3, wherein the charge controlling voltage is a direct current (DC) voltage.

5. The image forming apparatus as recited in claim 1, further comprising a blade for limiting the thickness of the toner attached to the developing roller, the blade being placed apart from the developing roller by a predetermined distance.

6. The image forming apparatus as recited in claim 1, further comprising a blade for limiting the thickness of the toner attached to the developing roller, the blade contacting with the developing roller.

7. An image forming apparatus capable of controlling a charge of a toner, comprising:

a toner supplying roller for charging toner to a predetermined level of charge;

a developing roller for supplying the toner from the toner supplying roller to an organic photoconductor;

a charge controller for increasing/decreasing the charge of the toner attached to the developing roller;

a blade for limiting the thickness of the toner attached to the developing roller, the blade being placed apart from the developing roller by a predetermined space;

a blade current detector for detecting a current for a blade voltage supplied to the blade;

a developing current detector for detecting a change in current with respect to a developing voltage supplied to the developing roller; and a blade voltage controller for increasing/decreasing a blade voltage supplied to the blade according to the detection result of the developing current detector.

8. The image forming apparatus as recited in claim 7, wherein the blade contacts the developing roller.

9. The image forming apparatus as recited in claim 7, wherein the blade voltage controller includes data on the blade voltage corresponding to the developing current in the form of a lookup table and changes the blade voltage according to a difference between the voltage for the developing current and the blade voltage.

10. The image forming apparatus as recited in claim 9, wherein the blade voltage controller comprises:

an analog-digital converter for performing analog-digital conversion on a detection result of the developing current detector;

a memory for storing data on the blade voltage corresponding to the detected developing current; and a processor for comparing the conversion result of the analog-digital converter with the data on the blade voltage and increasing/decreasing the blade voltage based on the comparison result.

11. An image forming apparatus, comprising:

a developing roller for performing development by carrying toner;

a toner layer limiting means for forming a toner layer having a uniform thickness on the developing roller;

a toner supplying roller for supplying the toner to the developing roller;

a charge controller for controlling a charge by contacting the developing roller under a development area;

an environment detector for detecting the state of an environment of the image forming apparatus; and a controller for controlling the voltage of the charge controller variably based on the environmental state detected in the environment detector.

12. The image forming apparatus as recited in claim 11, wherein the environment detector is any one of a thermosensor and a hygrosensor for detecting a temperature and a humidity.

13. The image forming apparatus as recited in claim 11, further comprising:

an organic photoconductor for forming an electrostatic latent image and attaching the toner supplied from the developing roller onto the formed electrostatic latent image;

a charging roller for charging the organic photoconductor with a predetermined voltage; and a transferring roller for fusing an image based on the electrostatic latent image formed in the organic photoconductor on paper, wherein the environmental state is any one of a current of the charging roller and a current of the transferring roller.

14. The image forming apparatus as recited in claim 11, wherein the image forming apparatus uses a non-magnetic and non-contact one-ingredient developing method.

15. A method of controlling a charge of a toner, comprising:

charging toner to a predetermined level of charge;

supplying the toner from a toner supplying roller to an organic photoconductor;

selectively increasing and decreasing the charge of the toner attached to a developing roller;

detecting a change in current with respect to a developing voltage supplied to the developing roller; and increasing or decreasing a charge controlling voltage supplied to the charge controller according to the detection result of a developing current detector.

16. The method of claim 15 further comprising:

changing the charge controlling voltage corresponding to a developing current according to the change in the developing current.

17. The method of claim 16 wherein the changing step further comprises:

performing analog-digital conversion on a detection result of the developing current detector;

storing data on the charge controlling voltage corresponding to the developing voltage; and comparing a conversion result of an analog-digital converter with the data on the charge controlling voltage and increasing or decreasing the charge controlling voltage based on the comparison result.

18. The method of claim 15 further comprising:

limiting the thickness of the toner attached to the developing roller.

* * * * *